US012096823B1

(12) United States Patent
Glancy et al.

(10) Patent No.: US 12,096,823 B1
(45) Date of Patent: Sep. 24, 2024

(54) ARTICLE OF FOOTWEAR

(71) Applicant: Under Armour, Inc., Baltimore, MD (US)

(72) Inventors: Michael Glancy, Baltimore, MD (US); Michael Forsey, Portland, OR (US)

(73) Assignee: Under Armour, Inc., Baltimore, MD (US)

( * ) Notice: Subject to any disclaimer, the term of this patent is extended or adjusted under 35 U.S.C. 154(b) by 0 days.

(21) Appl. No.: 16/700,512

(22) Filed: Dec. 2, 2019

Related U.S. Application Data

(60) Provisional application No. 62/773,515, filed on Nov. 30, 2018.

(51) Int. Cl.
*A43B 5/18* (2006.01)

(52) U.S. Cl.
CPC ..... *A43B 5/185* (2013.01)

(58) Field of Classification Search
CPC ..... A43B 5/185; A43B 5/001; A43B 13/127; A43B 13/188; A43B 13/16; A43B 23/0275
USPC ..... 36/314
See application file for complete search history.

(56) References Cited

U.S. PATENT DOCUMENTS

| | | | | |
|---|---|---|---|---|
| 1,039,396 A | | 9/1912 | Hilgert | |
| 1,122,850 A | * | 12/1914 | Brooks | D03D 51/20 139/365 |
| 1,477,825 A | | 12/1923 | George | |
| 2,216,630 A | | 10/1940 | Isadore et al. | |
| 2,616,190 A | | 11/1952 | Darby et al. | |
| 2,847,769 A | | 8/1958 | Schlesinger | |
| 2,909,854 A | | 10/1959 | Marie | |
| 3,082,549 A | | 3/1963 | Dolceamore | |
| 3,789,523 A | | 2/1974 | Rubin | |
| 4,180,924 A | | 1/1980 | Subotnick | |
| 4,364,189 A | | 12/1982 | Bates | |
| 4,445,283 A | | 5/1984 | Meyers | |

(Continued)

FOREIGN PATENT DOCUMENTS

| | | |
|---|---|---|
| CN | 101485509 A | 7/2009 |
| DE | 660551 C | 5/1938 |

(Continued)

OTHER PUBLICATIONS

"Superelastic Foam for Running Shoes." Superelastic Foam for Running Shoes, Dec. 12, 2018, https://www.basf.com/us/en/who-we-are/innovation/our-innovations/superelastic-foam-for-running-shoes.html. (Year: 2018).*

(Continued)

*Primary Examiner* — Grace Huang
(74) *Attorney, Agent, or Firm* — Maginot, Moore & Beck, LLP

(57) ABSTRACT

An article of footwear includes a sole structure and an upper. The sole structure includes a zoned plate with stability areas and flexure areas. The sole structure may further include a two-part midsole including a low recovery foam and a high recovery foam. In another embodiment, the sole structure includes reinforcing plate placed at a selected location between the zoned plate and a midsole. With this configuration, the sole structure encourages proper foot placement along the sole structure during a golf swing, thereby increasing shoe contact time with the ground and/or golf swing mechanics.

20 Claims, 12 Drawing Sheets

(56) References Cited

U.S. PATENT DOCUMENTS 4,620,376 A 11/1986 Talarico
4,642,911 A 2/1987 Talarico
4,685,227 A 8/1987 Simmons
4,704,809 A 11/1987 Ballard
4,747,410 A 5/1988 Cohen
4,754,561 A 7/1988 Dufour
4,862,605 A 9/1989 Gardner et al.
4,875,683 A 10/1989 Wellman
4,953,311 A 9/1990 Bruggemeier
5,022,168 A * 6/1991 Jeppson, III ..... A43B 1/04 36/43
5,036,851 A 8/1991 Cohen
5,389,184 A * 2/1995 Jacaruso ..... B29C 66/3034 156/378
5,964,048 A 10/1999 Shieh
6,016,613 A 1/2000 Campbell et al.
6,076,284 A * 6/2000 Terlizzi ..... A43B 5/00 36/103
6,158,151 A 12/2000 Won
6,675,505 B2 1/2004 Terashima
6,705,027 B1 3/2004 Campbell
6,775,930 B2 * 8/2004 Fuerst ..... A43B 13/188 36/103
6,817,117 B1 11/2004 Campbell
6,834,446 B2 12/2004 McMullin
7,234,251 B2 * 6/2007 Fuerst ..... A43B 1/0027 36/11.5
7,526,680 B2 * 4/2009 Mathew ..... G06F 11/3409 714/32
7,530,183 B2 * 5/2009 Munns ..... A41D 13/0543 36/113
7,559,160 B2 7/2009 Kelly
7,650,707 B2 * 1/2010 Campbell ..... A43B 5/001 36/127
7,712,231 B2 5/2010 Umezawa et al.
7,895,773 B2 3/2011 Robinson, Jr.
8,302,329 B2 * 11/2012 Hurd ..... A43B 23/08 36/88
8,375,604 B2 2/2013 Eder
8,607,479 B2 12/2013 Schwarz
8,631,592 B2 1/2014 Adair et al.
8,707,586 B2 4/2014 Adair et al.
8,793,902 B2 * 8/2014 Besanceney, III ... A43B 13/127 36/3 B
8,914,998 B2 * 12/2014 Gheorghian ..... A43B 13/22 36/103
8,938,893 B2 1/2015 Adair et al.
9,295,300 B2 3/2016 Adair et al.
9,521,876 B2 * 12/2016 Jones ..... A43B 17/18
9,545,129 B2 1/2017 Adair et al.
9,572,398 B2 * 2/2017 Hurd ..... A43B 13/026
9,603,412 B2 3/2017 Adair et al.
9,615,625 B1 * 4/2017 Huard ..... A43B 13/141
9,717,302 B2 8/2017 Adair et al.
9,770,066 B2 * 9/2017 Grelle ..... A43B 7/1405
9,788,599 B2 * 10/2017 Hesterberg ..... A43B 13/12
9,795,182 B2 * 10/2017 Yang ..... B29D 35/02
9,879,133 B2 * 1/2018 Baghdadi ..... C08L 23/0853
9,930,927 B2 * 4/2018 Luedecke ..... A43B 13/04
9,950,486 B2 * 4/2018 Hartmann ..... A43B 13/12
9,961,957 B2 5/2018 Adair et al.
10,045,583 B2 * 8/2018 Sturgis ..... A43B 7/141
10,092,061 B2 10/2018 Adair et al.
10,092,064 B2 * 10/2018 Ringholz ..... A43B 17/02
10,123,585 B2 * 11/2018 Price ..... A43B 13/26
10,238,168 B2 * 3/2019 James ..... A43C 5/00
10,258,104 B2 * 4/2019 Kraft ..... A43B 13/04
10,271,611 B2 4/2019 Adair et al.
10,299,533 B2 5/2019 Adair et al.
10,321,735 B2 * 6/2019 Connell ..... A43B 13/206
10,435,825 B2 * 10/2019 MacGilbert ..... D04B 7/14
10,582,741 B2 * 3/2020 Dombrow ..... A43C 1/04
10,674,786 B2 6/2020 Adair et al.
10,856,604 B2 * 12/2020 Tanaka ..... A43B 13/187
11,013,291 B2 5/2021 Adair et al.
11,033,066 B2 * 6/2021 Parke ..... A43B 17/006
11,064,760 B2 7/2021 Adair et al.
11,089,835 B2 * 8/2021 Eldem ..... A43B 13/188
11,122,863 B2 * 9/2021 Meir ..... A43B 23/0245
11,172,728 B2 11/2021 Adair et al.
11,375,768 B2 7/2022 Adair et al.
11,510,456 B2 11/2022 Adair et al.
11,700,911 B2 * 7/2023 Nakaya ..... A43B 13/188 36/28
2002/0069556 A1 * 6/2002 Paxton ..... A43C 11/10 36/51
2002/0139011 A1 10/2002 Kerrigan
2002/0144439 A1 10/2002 Price
2006/0000114 A1 1/2006 Love
2006/0090373 A1 * 5/2006 Savoie ..... A43C 15/162 36/67 D
2007/0199213 A1 8/2007 Campbell
2008/0163513 A1 7/2008 Chapman et al.
2008/0271346 A1 11/2008 Farmer
2009/0193682 A1 * 8/2009 Rosenbaum ..... A43B 13/187 36/88
2009/0272008 A1 * 11/2009 Nomi ..... A43B 13/36 36/91
2009/0293307 A1 12/2009 Koyama
2010/0115793 A1 5/2010 Kraisosky
2012/0036740 A1 * 2/2012 Gerber ..... A43B 13/125 36/134
2012/0324758 A1 * 12/2012 Tang ..... A43B 13/187 36/28
2013/0000146 A1 * 1/2013 Brandstatter ..... A43B 7/142 36/28
2013/0081306 A1 * 4/2013 Park ..... A43B 7/145 36/43
2013/0333247 A1 * 12/2013 Grott ..... A43C 9/00 36/127
2013/0340280 A1 * 12/2013 Swigart ..... A43B 13/02 36/43
2014/0259801 A1 * 9/2014 Grondin ..... A43B 13/187 264/48
2015/0082668 A1 * 3/2015 Nonogawa ..... A43B 13/16 36/30 R
2015/0272269 A1 * 10/2015 Niskanen ..... A43B 7/1425 36/30 R
2016/0015120 A1 1/2016 Denison et al.
2016/0242498 A1 * 8/2016 Sakamoto ..... A43B 7/1495
2018/0295936 A1 * 10/2018 Hansen ..... A43B 3/0078
2018/0360156 A1 * 12/2018 Whiteman ..... A43B 23/0265
2019/0116929 A1 * 4/2019 Kurcinka ..... A43B 13/04
2019/0200700 A1 * 7/2019 Hale ..... A43B 13/20
2019/0365048 A1 * 12/2019 Fontaine ..... A43B 23/042
2020/0170338 A1 * 6/2020 Lucca ..... B32B 27/08
2020/0305541 A1 * 10/2020 Yahata ..... A43B 13/023
2021/0401117 A1 * 12/2021 Tanabe ..... A43B 13/127

FOREIGN PATENT DOCUMENTS

DE 1000716 B 1/1957
EP 1712147 A1 * 10/2006 ..... A43B 23/0275
EP 1993391 B1 9/2012
EP 2522239 B1 9/2015
FR 1141593 A 9/1957
FR 2595552 A1 9/1987
FR 3036927 A1 * 12/2016 ..... A43B 13/14
GB 599832 A 6/1945
GB 675012 A * 7/1952 ..... A43B 13/04
JP 2007244521 A 9/2007
JP 2012139348 7/2012
KR 200331191 Y1 10/2003
KR 200425443 Y1 9/2006
KR 100776125 B1 11/2007
KR 101172957 B1 8/2012
WO 1985004558 A1 10/1985
WO 2006129951 A1 12/2006

(56) References Cited

OTHER PUBLICATIONS

DOW Chemical Company. "Winning the Race in Footwear Foams." DOW, Jan. 2017, https://www.dow.com/content/dam/dcc/documents/en-us/mark-prod-info/788/788-11101-01-winning-the-race-in-footwear-foams-infuse-olefin-block-copolymers-obcs1.pdf. (Year: 2017).*
U.S. Appl. No. 62/575,922 for Kurcinka et al (Year: 2017).*
English Translation of JP2007244521A. (4 Pages).
English Translation of KR200425443UY1. (2 Pages).
English Translation of KR100776125B1. (4 Pages).
English Translation of KR101172957B1. (7 Pages).
English Translation of CN101485509A. (8 Pages).
English Translation of KR200331191UY1. (3 Pages).

* cited by examiner

ARTICLE OF FOOTWEAR

CROSS REFERENCE TO RELATED APPLICATIONS

The present application is a nonprovisional of provisional application 62/773,515, filed 30 Nov. 2018 and entitled "Article of Footwear," the disclosure of which is incorporated herein by reference in its entirety.

FIELD OF THE INVENTION

The present invention relates to an article of footwear and, in particular, to shoe with traction elements.

BACKGROUND

Articles of footwear are provided in various forms and configurations. Footwear may be constructed to aid the wearer in a desired task. For example, running shoes are configured to mitigate forces applied to the wearer during the gait cycle, as well as compensate for pronation and supination. Cleats are configured to provide additional traction on natural and artificial turf. In golf, several forces are involved during a golf swing. Rotary, horizontal and vertical forces on a user cooperate to affect club velocity and, ultimately, ball launch conditions. Accordingly, it would be desirable to provide an article of footwear configured to assist a golfer during game play, e.g., during the golf swing.

SUMMARY

An article of footwear includes a sole structure and an upper. The sole structure is configured to control weight shift and/or enhance ground contact. The sole structure includes a zoned plate with stability areas and flexure areas. In an embodiment, the sole structure may further include a two-part midsole including a low recovery foam and a high recovery foam. In another embodiment, the sole structure includes reinforcing plate placed at a selected location between the zoned plate and a midsole. The sole structure further includes traction elements configured to resist rotational movement (e.g., during the swing). The upper includes a woven textile with yarns fused at selected locations to provide lockdown of the foot within the foot cavity. The show is configured to guide weight placement during a golf swing to control the center of gravity of a wearer, thereby improving swing mechanics.

The above and still further features and advantages of the present invention will become apparent upon consideration of the following detailed description of specific embodiments thereof.

BRIEF DESCRIPTION OF THE DRAWINGS

Like reference numerals have been used to identify like elements throughout this disclosure.

DETAILED DESCRIPTION

Figure 1A:
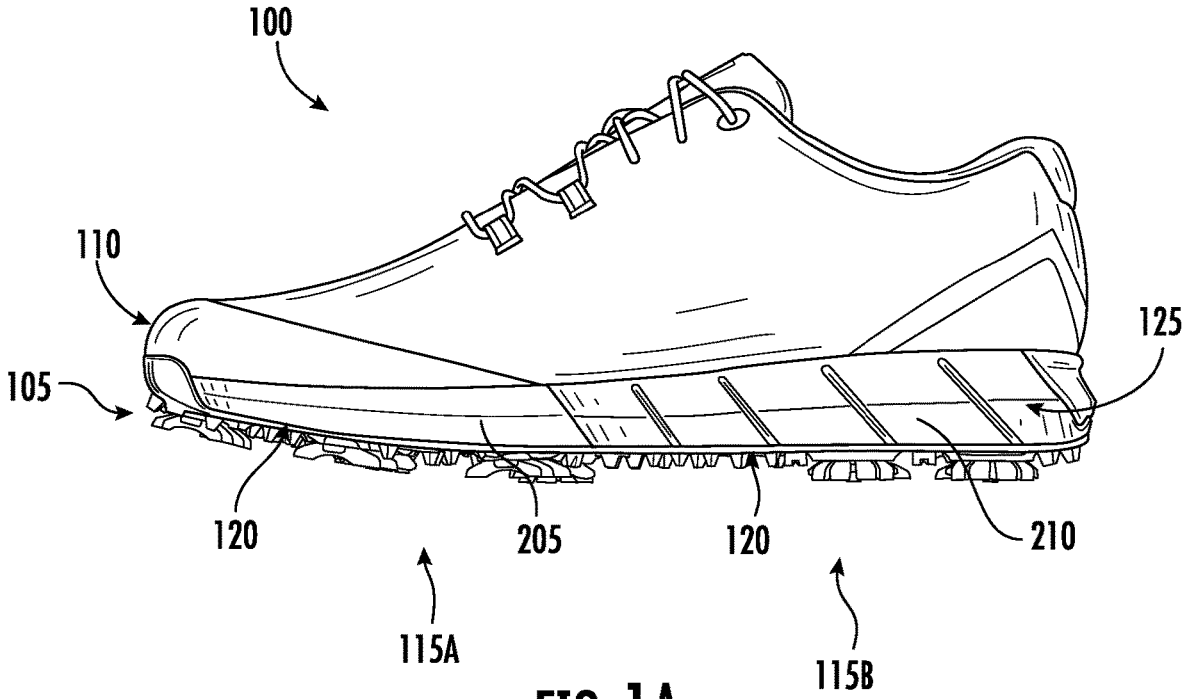
FIG. 1A is a medial side view of the right footed article of footwear in accordance with an embodiment of the invention.

In the following detailed description, reference is made to the accompanying figures which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

During a golf swing, controlling biomechanics—including the center of gravity—is important to maximize launch conditions. For example, weight at the set-up of the swing should be centered in the middle of the feet to optimize the balance with the body's center of gravity. During the backswing, the weight should move along what is called the "Hendrix torsion bar" (HB) an anatomical axis running from the second metatarsal (toe) through the center of the calcaneus (heel) (see FIGS. 9 and 10). Optimally for a right-handed golfer, during the backswing, the weight in the left (front) foot should shift forward along the Hendrix bar towards the metatarsals (toes), while the weight of the right (back) foot should shift rearward along the Hendrix bar toward the heel. At the top of the backswing, then, the weight should be applied towards the front of the left (front) foot and deep into the heel of the right (back) foot. Finally, on the downswing, the weight of the left (front) foot along should travel backward (along the Hendrix bar) to a central point on the heel, with as much as 80% of the player's weight on the left foot at impact.

Most golfers, however, do not naturally shift weight appropriately during the golf swing. For example, even on a level surface, golfers tend to begin in a position that places too much weight on the front of the feet, upsetting the center of gravity. At the top of the backswing, moreover, golfers will roll onto the inside of the left (front) foot, losing weight shift containment. On the downswing, rotational or torsional forces are generated as the player pushes off with the rear foot and leg, shifting the weight toward his/her left (front) foot. On contact, most golfers move the weight of the left (front) foot toward the toes, lifting the heel off of the ground and upsetting the center of gravity. This, in turn, prevents proper rotation and correct hip clearance. Thus, improper location of the weight interferes with arm and body coordination, including hip rotation during the swing. This, in turn, affects swing speed and power.

Figure 1B:
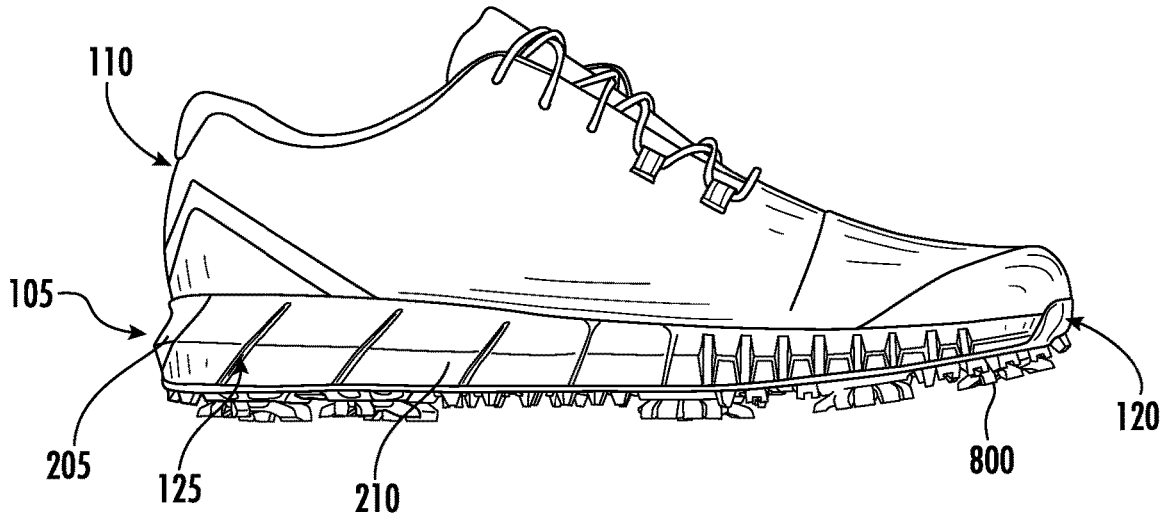
FIG. 1B is a lateral side view of the article of footwear shown in FIG. 1A.
Figure 1C:
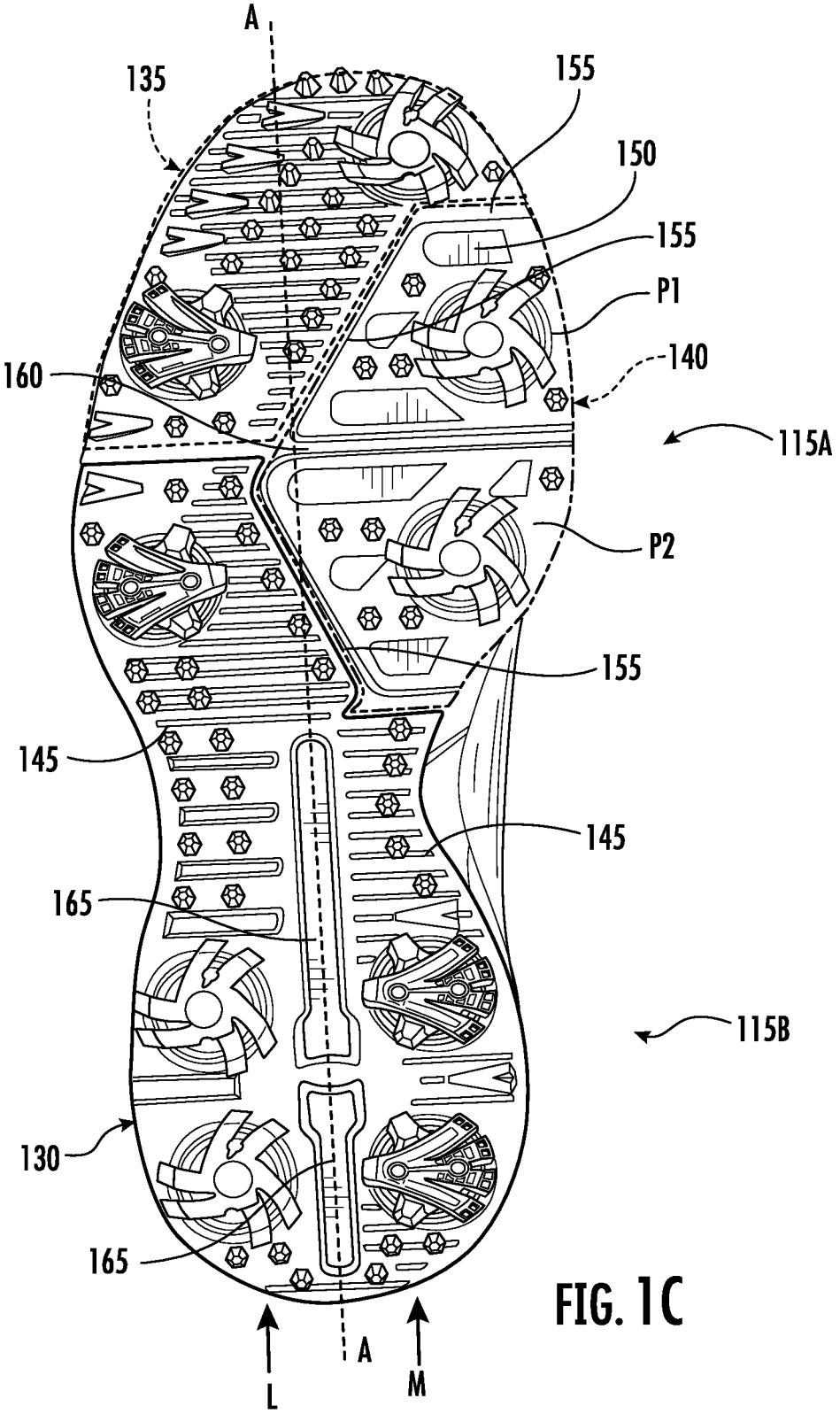
FIG. 1C is a bottom view of the article of footwear shown in FIG. 1A, showing the bottom plate of the sole structure.

In light of the above, it is desirable to provide a shoe capable of guiding the distribution of weight during a swing to properly position a player's center of gravity and/or to resist foot rotation in a clockwise or counterclockwise direction. Referring to FIG. 1, the article of footwear 100 includes a sole structure 105 and an upper 110 each defining a forefoot section 115A and a hindfoot section 115B. The sole structure 105 (which may also be referred to herein as an "outsole") includes an outer/bottom sole or plate 120 defining a lower (playing surface) side and an upper (user facing) side. A midsole 125 is positioned on (e.g., mounted, attached, or otherwise positioned in proximity of or adjacent to) the upper side of the outsole.

Figure 2:
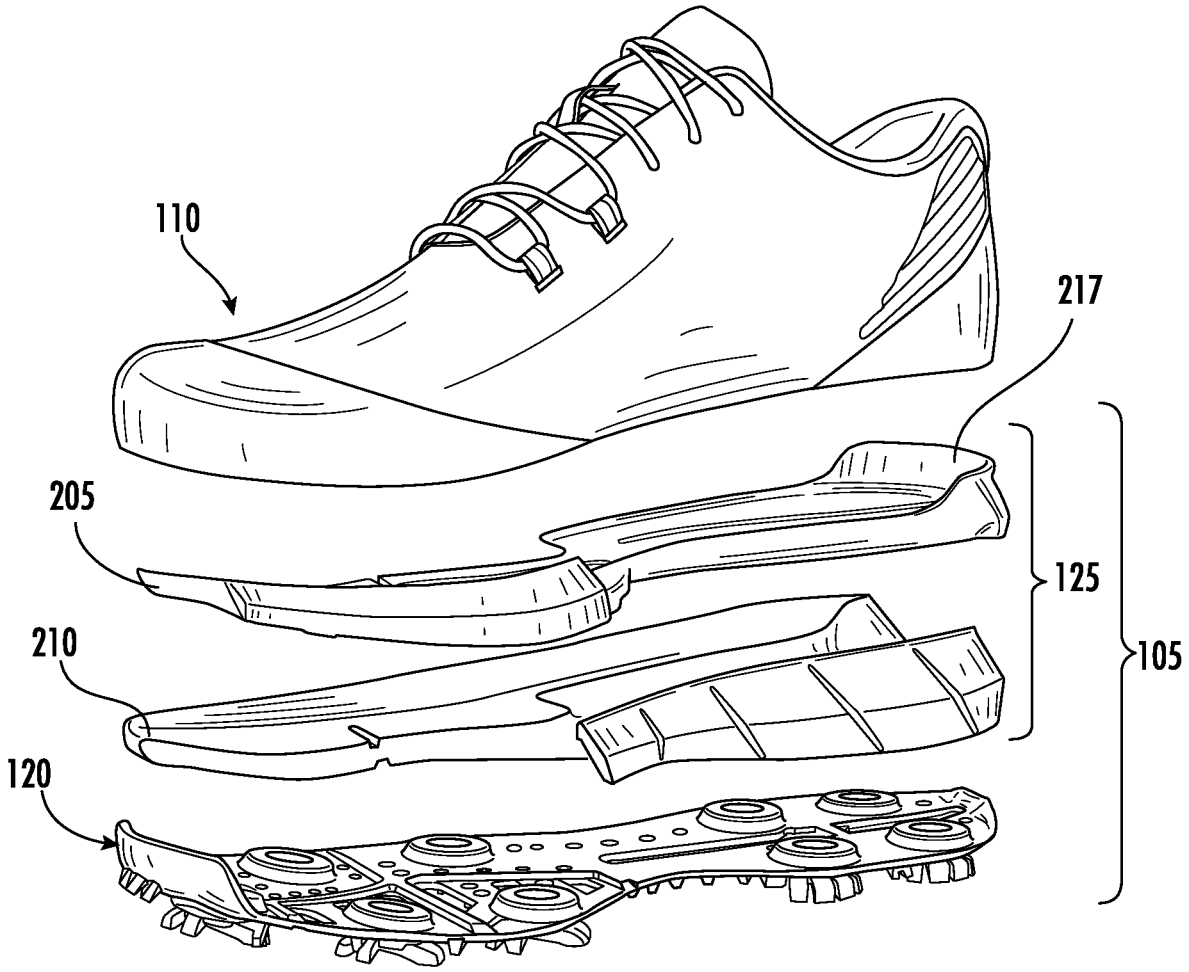
FIG. 2 is an exploded view of an article of footwear shown in FIG. 1A.

The plate 120 is configured to provide stability while permitting flexure of the forefoot along the Hendrix bar. The plate 120 is formed of a flexible material such as a thermoplastic polymer. By way of example, the plate is formed of thermoplastic polyurethane (TPU). The plate 120 includes predetermined stability zones and flexure zones. Referring to FIG. 2, the plate 120 includes a first or hindfoot stability zone 130, a second or forefoot stability zone 135 and a medial forefoot flexure zone 140. The stability zones 130, 135, while resilient, are configured to resist flexure under load conditions. Accordingly, these areas of the plate are thicker relative to the plate of the flexure zone. By way of example, these areas may possess a thickness of one millimeter or more (e.g., 1.5 mm). Additionally, these areas may contain reinforcing structural ribs 145 extending transversely (from lateral to medial) along the plate. As shown, the first stability zone 130 spans the lateral L and medial M sides of the hindfoot 115B, narrowing as it enters the forefoot such that it remains solely within the lateral side L of the plate 120. To permit flexure between the lateral L and medial M sides of the first stability zone 130, one or more (e.g., a plurality of) longitudinal cut-outs or windows 165 is provided, being centrally disposed along the longitudinal axis A of the shoe, within the hindfoot section 115B. Similarly, the second stability zone 135, disposed forward of the first stability zone 130, begins along the lateral side L of the plate 120, expanding into the medial side M such that it spans the entire front of the plate along the toe cap.

The flexure zone 140 is configured to permit flexure under load. Accordingly, it is thinner than the stability zones. By way of example, it possesses a thickness of less than one millimeter (e.g., 0.5 mm). The flexure zone 140 may further includes one or more (e.g., a plurality of) transverse cut-outs or windows 150 extending through the plate 120, thereby exposing the midsole 125. As shown, the forefoot flexure zone 140 is separated from the stability zones 130, 135 via a forefoot flex groove 155 running from a medial edge of the plate, curving along the longitudinal axis A, and then back to the medial edge. In addition, a transverse flex groove 160 extends across the plate, thereby separating the first stability zone 130 from the second stability zone 125, as well as dividing the flexure zone 140 into a first panel P1 and a second panel P2.

With this configuration, the flex grooves 155, 160 and the longitudinal windows 165 decouple the stability zones 130, 135 and the panels P1, P2 of the flexure zone 140, permitting each to move independently with respect to the others, based on load conditions (e.g., the windows decouple the area of the medial side of the heel from that of the lateral side of the heel). As noted above, golfers struggle to maintain resistance in the lower body as they reach the top of their swing. Instead, golfers tend to roll onto the lateral side of the left (forward) foot, losing ground contact and upsetting the center of gravity. The above-described plate 120 is configured to adapt to load conditions, permitting each zone to flex downward (toward the playing surface), under load, resisting roll over and improving ground contact time.

In addition, the zones 130, 135, 140 guide weight placement. As the golfer swings, the weight will shift in accordance with the player's tendencies. The stability zones, however, resist those tendencies that shift the weight to the lateral and/or medial extremes (e.g., within the hindfoot 115B), instead urging the the foot toward the center of the plate and the weight over the Hendrix bar (particularly when the load shifts toward the heel). In addition, as the load moves forward driven toward the medial side of the sole structure via the lower resistance afforded by the flexure zone 140.

Figure 3C:
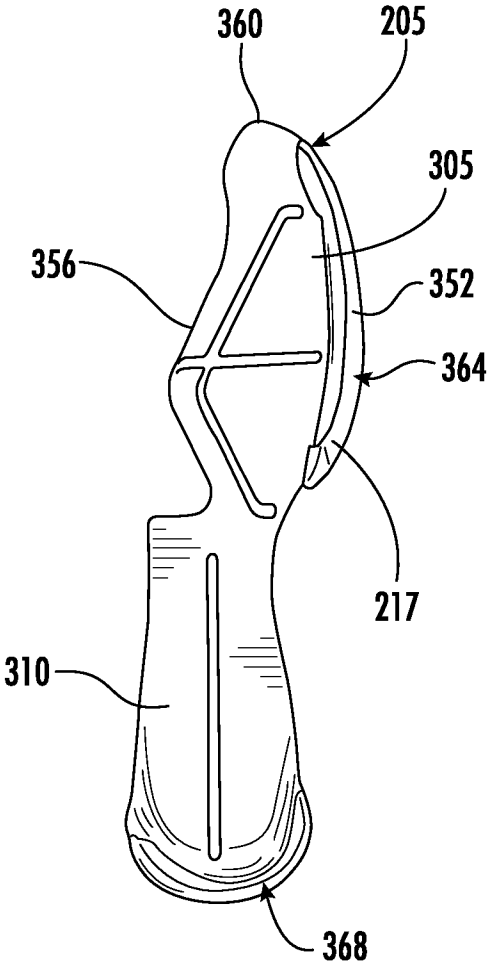
FIG. 3C is a top view of a second part of the midsole shown in FIG. 1A, shown in isolation.
Figure 3B:
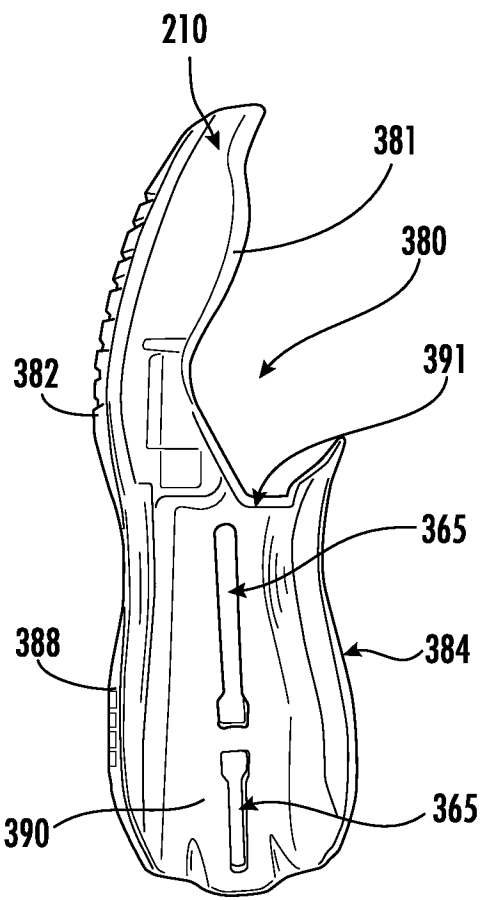
FIG. 3B is a top view of a first part of the midsole shown in FIG. 1A, shown in isolation.
Figure 3A:
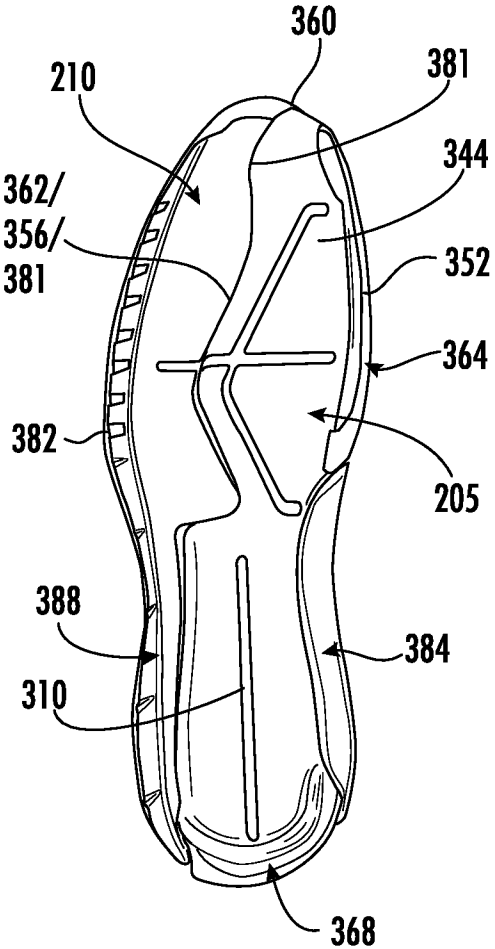
FIG. 3A is a top view of a two-part midsole in accordance with an embodiment of the invention, showing a left footed configuration.

The midsole 125, positioned between the upper 110 and the plate 120, may be configured to assist with weight load management. Referring to FIGS. 2 and 3A-3C, the midsole 125 is a two-part midsole including a first component 205 and a second component 210, wherein the first component 205 is operable to nest at least partially within the second component 210 (i.e., as shown in FIGS. 3A-3C, the hindfoot portion 310 of the first component 205 nests within the hindfoot portion of the second component 210, while the forefoot portion 305 of the first component 205 is adjacent to the forefoot portion of the second component 210). The first midsole component 205 is formed of a first compressible material having high recovery and/or rebounding properties compared to that forming the second midsole component 210. By way of example, the first compressible material is a high recovery foam formed of one or more olefin block copolymers including hard and soft segments. Examples of suitable olefin block copolymers are those including α-olefin (alpha olefin) multi-block interpolymers, where the α-olefins can include, without limitation, C3-C20 α-olefins (e.g., C3-C10 α-olefins), such as propylene, 1-butene, 1-pentene, 1-hexene, 1-heptene and 1-octene. By way of specific example, the olefin block copolymer is an ethylene/alpha-olefin block copolymer. Commercially available high recovery, olefin foam is sold under the trademark INFUSE® (Dow Chemical Company).

The foam of the first midsole component 205 may be entirely or substantially formed of the olefin copolymer. In other embodiments, the foam may include a blend of olefin foam and a non-olefin foam such as polyurethane or ethylene vinyl acetate. When blended, the olefin foam generally constitutes 65% by weight or more of the blend.

A textile web 217 may be coupled (e.g., bonded or attached) to the first midsole component 205. In an embodiment, the textile web is an open mesh fabric formed of elongated interwoven hard yarn strands (e.g., nylon) defining openings or apertures. The fabric may wholly or partially encase the first midsole component 205. The fabric may control movement of the foam and/or improve the compression and force attenuating properties thereof (e.g., by dispersing deformation along the part). In operation, it is believed that the web is effective to disperse a localized force on impact. In particular, on impact, the strands will tense, pulling toward the impact area and compressing areas outside the impact zone.

The second midsole component 210 is formed of compression material having low recovery and/or rebound properties compared to the compressible material forming the first midsole part 205. In an embodiment, the compressible material is a low recovery foam formed of ethylene vinyl acetate (18-24% vinyl acetate). The foam may be entirely or substantially formed of the low recovery (EVA) foam. By way of example, the ethylene vinyl acetate foam is present in an amount of 65% by weight or more, e.g., 100%.

Specifically, the low recovery, ethylene-vinyl-acetate-based foam possesses a rebound value of less than 50%, while the high-recovery, olefin-block-copolymer-based foam possesses a rebound value of greater than 50%. As a result, the low recovery foam may decrease in thickness over time at a higher rate than the high recovery foam. For example, in a test including 100,000 cycles at 40° C. with a force of 180 lbs per cycle (with subsequent rest at room temperature), the high-recovery (olefin-based) foam exhibited recovery of greater than 80% (e.g., 90%) while the low-recovery (ethylene-vinyl-acetate-based) foam exhibited a recovery of less than 70% (e.g., 7-10%).

In other embodiments, the second midsole component 210 is formed of compressible material possessing a durometer that differs from the durometer of the compressible material forming the first component 205. By way of example, the durometer value of the second midsole component 210 is greater than the durometer value of the first midsole component 205. Stated another way, the first midsole component is softer than the second midsole component.

The midsole components 205, 210 may possess any dimensions (size and/or shape) suitable for its described purpose. As shown, the first midsole component 205 includes a hindfoot portion 310 configured to span the lateral and medial sides of the shoe and a forefoot portion 305 that is offset from the hindfoot portion such that the forefoot portion 305 is positioned substantially or completely within the medial side of the shoe. Stated another way, the forefoot or forward portion 305 is offset from the hindfoot or rearward portion 310 such that the forward portion is oriented along the medial (big toe) side of the sole and the rearward portion 310 is approximately centered along the sole, being generally centrally positioned along the shoe central axis A (FIG. 1C) and surrounded by the low recovery foam on each of it lateral and medial sides.

Specifically, the midsole 125 extends from the hindfoot 115B and to the forefoot 115A of the shoe. The first midsole component 205 fits complementarily with the second midsole component 210 in such a way that the first and second midsole components form a partially nested and partially contiguous two-piece midsole. In particular, the first midsole component 205 is nested with the second midsole part 210 in the hindfoot region 115B, and the first midsole component 205 is laterally adjacent to and contiguous with the second midsole component 210 in the forefoot region 115A. The forward portion 305 extends lengthwise in the shoe 100 through approximately the forward medial half of the shoe 100, while the rearward portion 310 extends lengthwise in the shoe through approximately the central rear half of the shoe 100.

The first midsole part 205 is defined by a medial edge 352 and a lateral edge 356, each extending along opposite sides of the first midsole part 205. The medial edge 352 defines a medial side of the first midsole part 205 and extends from the medial forefoot region 344 to the hindfoot region of the shoe. In the forefoot region, the medial edge 352 is provided by a convex first surface 364 that curves outwardly from the forward-most point 360 of the first midsole part 205 and then curves back inwardly near the midfoot. This convex first surface 364 is exposed on the shoe 100 so that the first exposed surface 364 of the medial edge 352 is visible from the exterior of the shoe 100.

At the midfoot of the shoe 100, the medial edge 352 is generally concave in shape. In the hindfoot region 115B (i.e., in the rearward portion 310 of the first midsole part), the medial edge 352 extends in a relatively straight manner and then curves around to a second exposed surface 368 at the back of the heel in the hindfoot region of the shoe 100 (which second exposed surface 368 may also be referred to herein as a "exposed central hindfoot surface"). As explained in further detail below, the medial edge 352 is not exposed and visible along the medial side of the hindfoot region 115B of the shoe but is instead nested and confined within the second midsole part 210. Nevertheless, the medial edge does merge into the second exposed surface 368 of the first midsole part 205 in a back-heel region of the shoe 100 (i.e., a rear portion of the hindfoot region).

The lateral edge 356 of the first midsole part 205 includes a plurality of curvatures in the forefoot region. The lateral edge 356 includes a first convex portion near the forward-most point 360. This first convex portion transitions into a concave portion near the center of the forefoot region. This concave portion then transitions into a second convex portion near or in the midfoot. As a result of these curvatures, the forward portion 305 of the first midsole part 205 varies in diameter and has its widest dimension at approximately one third of the length of the shoe 100 from the forward-most point 360 to the heel, or approximately where the ball of a wearer's foot is located. The first midsole part 205 generally has its thinnest dimension near the center of the shoe 100 in the midfoot (with the exception of dimensions near the tips of the forefoot region and the hindfoot region).

The lateral edge 356 of the rear portion 310 extends in a relatively straight manner and then curves around to the second exposed surface 368. The lateral edge 356 itself is not exposed on the exterior of the shoe 100. Instead, the entire lateral edge 356, including the forward portion 305 and the rear portion 310 abuts portions of the second midsole part 210. The rear portion 310 of the first midsole part 205 is generally centered between the medial side and the lateral side of the shoe 100. At the back-heel region of the shoe 100, the rear portion 310 defines the second exposed surface 368 whereas the first midsole part 205 is exposed outside the shoe 100.

The second midsole component 210 is defined by a medial edge 381 and a lateral edge 382, each extending along opposite sides of the component. The lateral edge 382 defines a lateral side of the second midsole part 210 and extends from the lateral forefoot region 115A to the hindfoot region 115B of the shoe. In the forefoot region 115A, the lateral edge 382 is provided by a convex surface that curves outwardly from the forward-most point of the second midsole part 210 and then curves back inwardly at the midfoot. The lateral edge 382 is then defined by a concave surface between the midfoot and the hindfoot region 115B. The lateral edge 382 defines a convex surface in the hindfoot region. The entire lateral edge 382 is exposed along the exterior of the shoe 100.

The medial edge 381 of the second midsole part 210 is complementary to the lateral edge 356 of the first midsole part 205 in the forefoot region of the shoe 100. In the midfoot of the shoe 100, the medial edge 381 extends laterally until it reaches the medial side of the shoe 100. There, in the midfoot, the medial edge 381 is defined by a concave surface between the midfoot region and the hindfoot region 115B. The medial edge 381 is then defined by a convex surface in the hindfoot region 115B. The medial edge 381 of the second midsole part 210 is exposed in the hindfoot region 115B on the exterior of the shoe 100.

The medial edge 381 in the forefoot region of the second midsole part 210 defines a void/cutout 380 that has generally the same shape as the first midsole part 205. As a result, the first midsole part 205 fits complementarily into the cutout 380 in such a way that the lateral edge 356 of the first midsole part 205 abuts the medial edge 381 of the second midsole part 210. Accordingly, when the first midsole part 205 is fitted with the second midsole part 210, the top and bottom surfaces of the first and second midsole parts form generally continuous surfaces that extend across the entire in the forefoot and midfoot regions of the shoe 100 with a seam 362 formed between the medial forefoot region and the lateral forefoot region where the abutment of the lateral edge 356 of the first midsole part 205 occurs with the medial edge 381 of the second midsole part 210. As will be recognized from reviewing FIGS. 3A-3C, the seam 362 extends through the midsole from the upper surface to the lower surface of the midsole. Additionally, the seam 362 is located on the midsole between the first midsole part 205 and the second midsole part 210. Furthermore, because the seam 362 is defined by a plurality of curves that extend along the length of the seam.

A recess 391 (which may also be referred to herein as a "cavity") is formed in a middle section 390 of the upper surface of the hindfoot region of the second midsole part 210. The recess 391 in the middle section 390 is defined between a hindfoot medial rim 384 and a hindfoot lateral rim 388 of the second midsole part 210. The hindfoot medial rim 384 is exposed on the exterior of the midsole in a midfoot and forefoot region on the medial side of the shoe between the first exposed surface 364 and the second exposed surface 368 of the first midsole part 205. Additionally, the hindfoot lateral side rim 388 of the second midsole part 210 is exposed on the exterior of the midsole on the entirety or substantially the entirety of the lateral side of the shoe 100. The hindfoot medial rim 384 and the lateral side rim 388 complementarily enclose the rearward portion 310 of the first midsole part 205 in such a way that the upper surfaces of the first and second midsole parts 205, 210 form a generally smooth and continuous upper surface of the midsole 324. Stated differently, in the hindfoot region 115B, the rear portion 310 of the first midsole part 305 is nested in the recess of the middle section 390 of the second midsole part 210.

As noted above, the middle section 390 spans between the hindfoot medial rim 384 and the lateral side rim 388 in the hindfoot half of the second midsole part 210. The middle section 390 defines two windows 365 extending generally longitudinally along the length of the second midsole part 210. The windows 365 extend substantially the entire length of the hindfoot half of the second medial part 210. For example, in one embodiment, the windows 365 extend along between 75% and 95% of the longitudinal extent of the hindfoot half of the second midsole part 210. The windows 365 align with the windows 165 of the plate 120 such that the bottom surface of the first midsole part 205 is visible through the windows 165, 365. As a result, the lateral and medial halves of the hindfoot half of the second midsole part 210 can move relative to one another about the longitudinal axis of the shoe 100 to allow for flexibility of the midsole 125.

The resulting structure results in a first component 105 with a centrally-disposed recess having a thin bottom and thicker side walls (thicker than the bottom wall) within the hindfoot 115B of the midsole 125. In the forefoot, however, the first component is exposed in the area generally in registry with the flexure zone to prevent any interaction with the low recovery foam of the second component. The described two-part midsole configuration works with the plate 120 to control weight displacement during the swing. The high recovery foam is generally softer than the low recovery foam. Accordingly, the low recovery foam disposed along the lateral and medial sides of the hindfoot 115B (and the lateral side of the forefoot 115A), being harder, resists a lateral or medial load shift, urging the foot toward the center of the sole structure and, in particular, onto the first midsole component formed of the high recovery foam (e.g., when the load shifts toward the heel). In addition, when the load shift toward the toes, the foot again is encouraged to follow the first midsole component toward the medial side, maintaining the load over the Hendrix bar.

Figure 4:
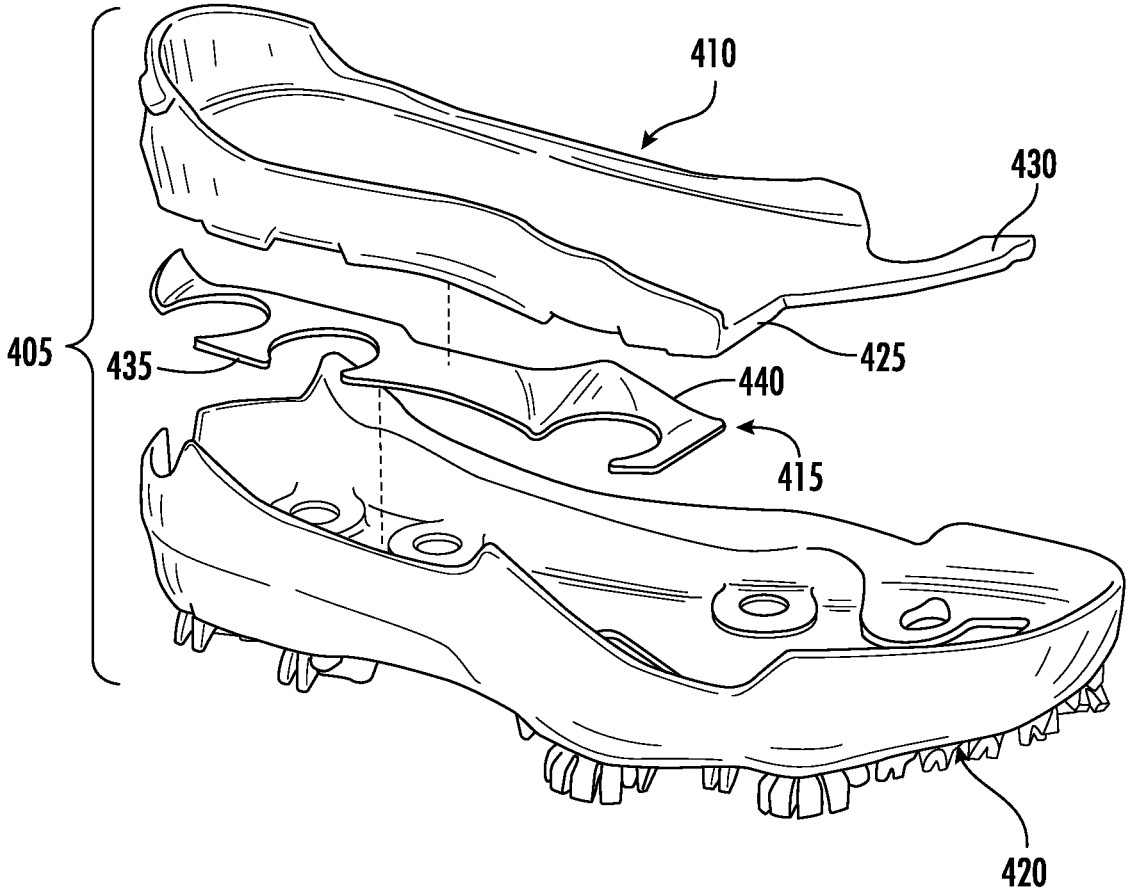
FIG. 4 is an exploded view of a sole structure for an article of footwear in accordance with an embodiment of the invention, showing a right footed configuration.
Figure 5:
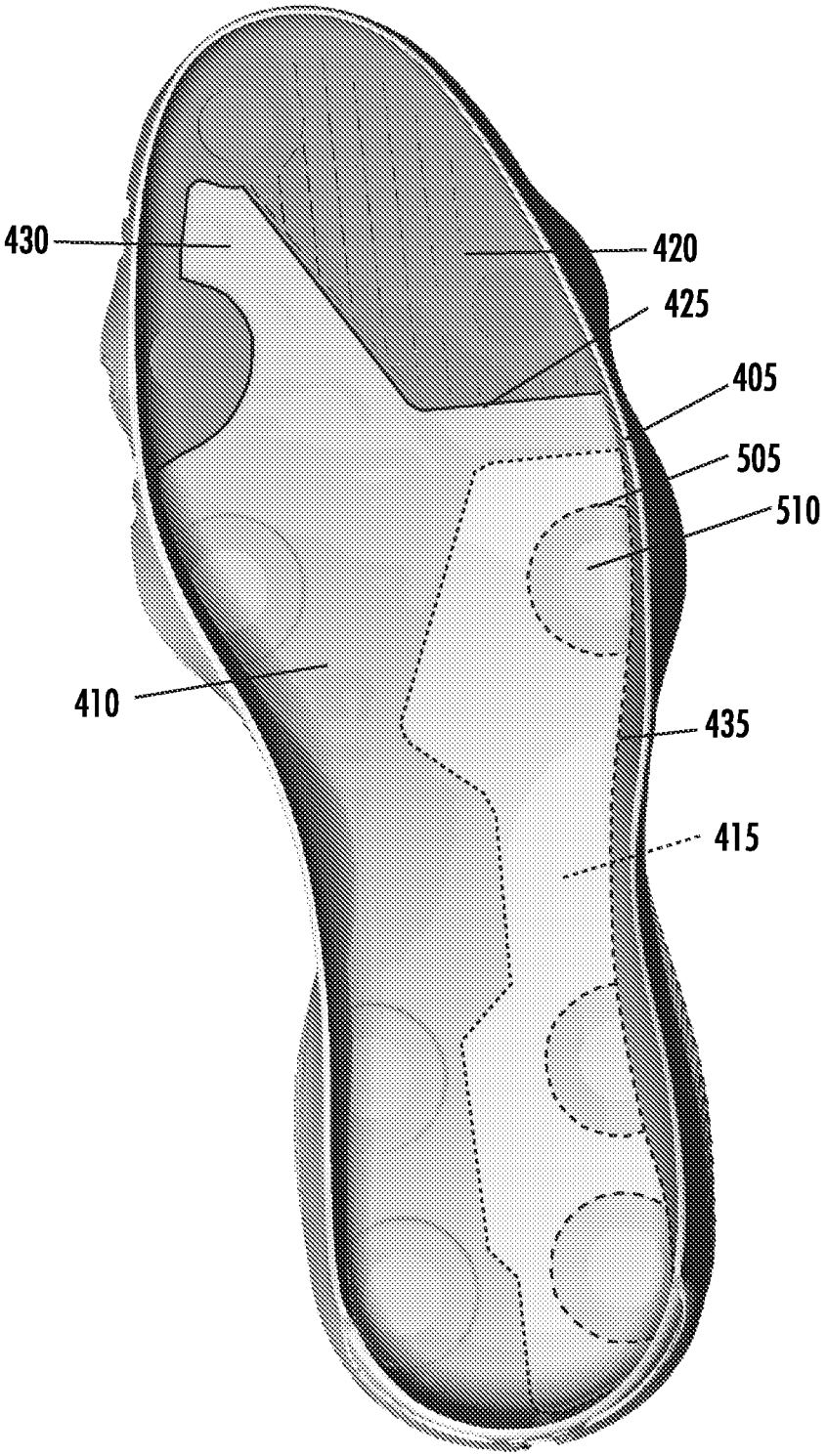
FIG. 5 is a top view of the sole structure shown in FIG. 4.
Figure 6A:
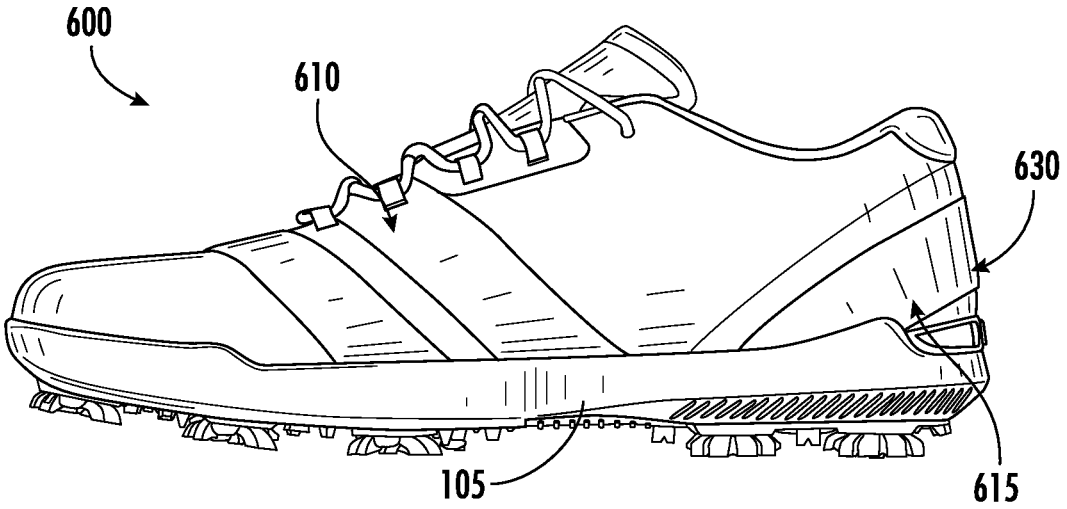
FIG. 6A is a medial side view of an article of footwear in accordance with an embodiment of the invention, showing a right footed configuration.
Figure 6B:
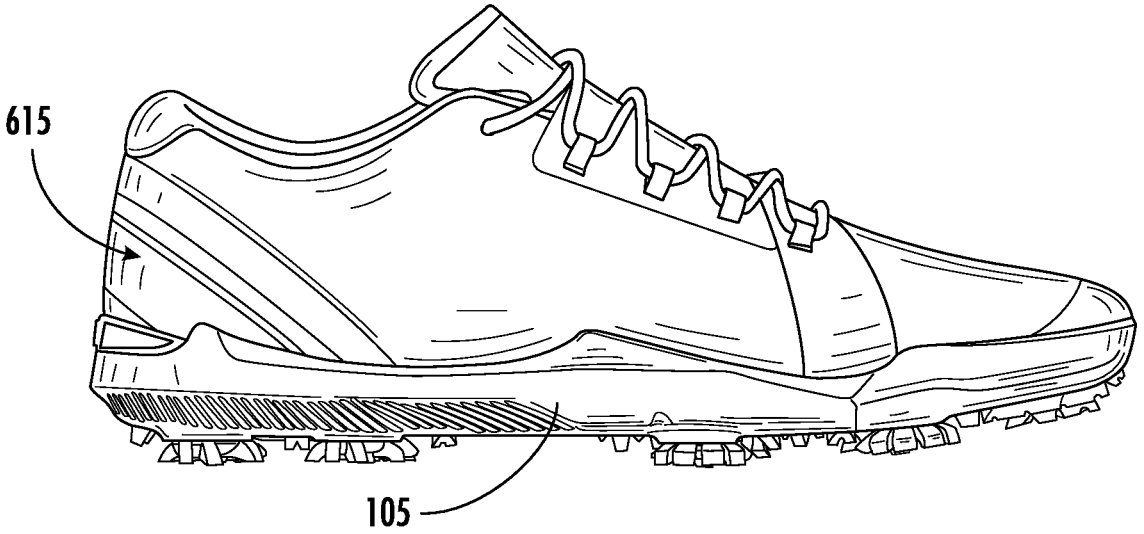
FIG. 6B is a lateral side view of the article of footwear shown in FIG. 6A.
Figure 6C:
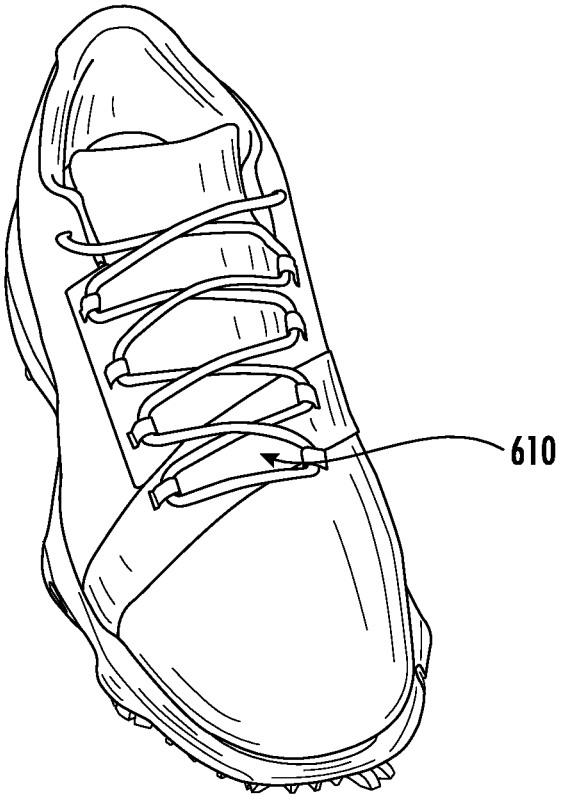
FIG. 6C is a front perspective view of the article of footwear shown in FIG. 6A.
Figure 6D:
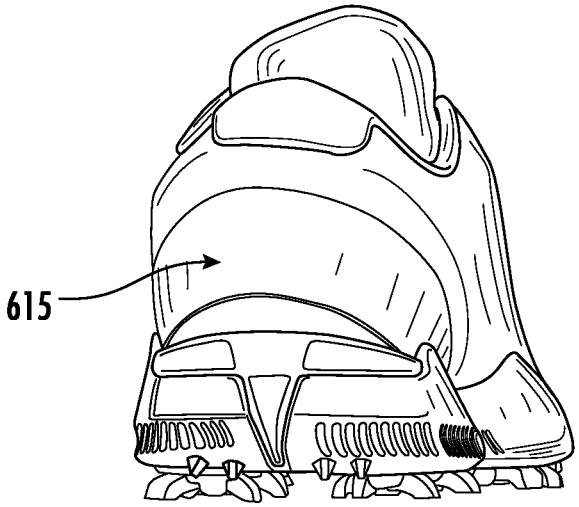
FIG. 6D is a rear perspective view of the article of footwear shown in FIG. 6A.

In an alternative embodiment, the sole structure includes an insert member or rigid shank operable to stabilize the sole structure against pivoting. Referring to FIG. 4, the sole structure 405 includes a one-part midsole 410, a high-tensile-strength, lateral shank or insert member 415, and a plate 420 with traction elements. The one-part midsole 410 is a monolithic (single) piece of compressible material. The compressible material is not particularly limited, and may include either the high recovery, olefin-block-copolymer foam or the low recovery, ethylene-vinyl-acetate-based foam (each as described above), polyurethane, or a combination thereof. By way of example, the midsole 410 is formed of a low recovery, ethylene vinyl acetate foam.

The midsole 410 may possess any dimensions (size and shape) suitable for its described purpose. In the embodiment illustrated, the midsole 410 is truncated, spanning the hindfoot and midfoot areas, but terminating proximate the cuneiform bones to define an edge 425 the forefoot. A tab 430 extends angularly from the edge 425, curving toward the medial shoe edge.

The lateral shank 415, disposed between the midsole 410 and the plate 420 is a rigid panel or plate configured to stabilize and limit flexure of the sole structure under load. In an embodiment, the lateral shank 415 is a carbon fiber composite panel including woven sheets of carbon fibers impregnated with a resin. Alternatively, the lateral shank 415 may be panel formed of a thermoplastic elastomer such as polyether block amide (PEBA). As shown, the shank 415 is disposed within the hindfoot of the sole structure, along the lateral side such that it extends inboard from the hindfoot lateral edge.

The shank 415 may be any dimensions (size and/or shape) suitable for its intended purpose. By way of example, the shank 415 may have a thickness of between approximately 0.5 mm and approximately 5 mm, a width at its widest point of between approximately 30 mm and approximately 70 mm, and a length at its longest point of between approximately 120 mm and approximately 250 mm. In an embodiment, the thickness of the shank 415 is between approximately 1 mm and approximately 3 mm, the width of the stability insert is between approximately 40 mm and 60 mm, and the length of the shank 415 is between approximately 170 mm and approximately 220 mm. A ratio of the thickness to the width of the shank 415 may be, for example, between approximately 1:10 to approximately 1:100, and a ratio of the thickness to the length of the stability insert may be, for example, between approximately 1:40 and approximately 1:300.

The lateral edge 435 of the shank 415 may generally follow the outer contour of the lateral side of the plate 435 and/or include cut outs 505 around the cleat mounts 510, forming three generally circular cutouts. The medially-facing edge 440 of the shank 415 extends from approximately the lateral center of the heel generally along the lateral center of the hindfoot region and the midfoot region. In the illustrated embodiment, the medial facing edge 440 protrudes from the lateral center into the medial half of the shoe in the hindfoot region and at approximately the longitudinal middle of the midfoot region but does not extend more than halfway across the medial half of the shoe at any point.

With this configuration, the shank 415 discourages the shoe from becoming imbalanced when should the weight shift to the lateral side during a swing. That is, since the medial side offers less resistance, the weight of the foot is encouraged to shift toward the medial side. Rotation toward the lateral side L of the show is resisted, preventing the medial side from rotating upward, off of the playing surface. Instead, the weight is maintained on each of the lateral and medial side, maintaining the contact of the traction elements with the playing surface.

The upper 600 may be formed of any material suitable for its described purpose. In an embodiment, the upper 600 is formed of a textile including areas of little (less than 5%) or no stretch in order to secure the foot against the sole structure. Referring to FIGS. 6A, 6B, 6C and 6D, the upper 600 includes a lockdown system configured to restrain the foot, holding it against the sole structure during a golf swing. The lockdown system includes a first or forward locking band 610 and a second or rearward locking band 615 (and a "locking band" may also be referred to herein as a "lockdown band"). The forward locking band 610 extends rearward from the lateral side of the upper 600 (beginning along the sole structure 105) to the medial side up the upper (terminating proximate (e.g., at the) sole structure). Accordingly, the locking band begins in the forefoot near the toe cage (proximate the metatarsal bone or the foot), extending angular rearward across the vamp to terminate in the midfoot (proximate the medial cuneiform of the foot).

The rearward locking band 615 is arranged generally along the heel 630 of the upper 600. The rearward locking band 615 begins at the base of the lateral side of the heel 630 at approximately the intersection between the midfoot third and the hindfoot third of the shoe 600 and ends on the medial side of the heel.

The bands 610, 615 may possess and dimensions (length, width, shape, etc.) suitable for its described purpose (to restrict foot movement within the shoe cavity). In some embodiments, the length is approximately 200 mm and approximately 300 mm. The forward locking band 610 may have a width of between approximately 10 mm and approximately 60 mm. In one embodiment, the forward locking band (e.g., when 300 mm) may have a width of between approximately 15 mm and approximately 25 mm. In some embodiments, the ratio of the length to width of the forward locking band 610 may be between 12:1 and 20:1. The rearward locking band 615 may have a length of, for example, between 200 mm and 300 mm. In an embodiment, the length of the rearward locking band 615 is between approximately 240 mm and 260 mm. The rearward locking band 615 may have a width (i.e. perpendicular to the length) of between approximately mm and 40 mm. In one embodiment, the rearward locking band 615 may have a width of between approximately 20 mm and approximately 30 mm. In some embodiments, the ratio of the length to width of the rearward locking band may be between 8:1 and 20:1. In an embodiment, the ratio of the length to width is approximately 12.5:1.

The upper locking bands are formed of interconnected strands. The term "strand" includes one or more filaments organized into a fiber and/or an ordered assemblage of textile fibers having a high ratio of length to diameter and normally used as a unit (e.g., slivers, roving, single yarns, plies yarns, cords, braids, ropes, etc.). In a preferred embodiment, a strand is a yarn, i.e., a continuous strand of textile fibers, filaments, or material in a form suitable for knitting, weaving, or otherwise intertwining to form a textile fabric. A yarn may include a number of fibers twisted together (spun yarn); a number of filaments laid together without twist (a zero-twist yarn); a number of filaments laid together with a degree of twist; and a single filament with or without twist (a monofilament).

The strands forming the band may be heat sensitive strands such as flowable (fusible) strands and softening strands. Flowable strands are include polymers that possess a melting and/or glass transition point at which the solid polymer liquefies, generating viscous flow (i.e., becomes molten). In an embodiment, the melting and/or glass transition point of the flowable polymer may be approximately 80° C. to about 150° C. (e.g., 85° C.). Examples of flowable strands include thermoplastic materials such as polyurethanes (i.e., thermoplastic polyurethane or TPU), ethylene vinyl acetates, polyamides (e.g., low melt nylons), and polyesters (e.g., low melt polyester). Preferred examples of melting strands include TPU and polyester. As a strand becomes flowable, it surrounds adjacent strands. Upon cooling, the strands form a rigid interconnected structure that strengthens the textile and/or limits the movement of adjacent strands.

Softening strands are polymeric strands that possess a softening point (the temperature at which a material softens beyond some arbitrary softness). Many thermoplastic polymers do not have a defined point that marks the transition from solid to fluid. Instead, they become softer as temperature increases. The softening point is measured via the Vicat method (ISO 306 and ASTM D 1525), or via heat deflection test (HDT) (ISO 75 and ASTM D 648). In an embodiment, the softening point of the strand is from approximately 60° C. to approximately 90° C. When softened, the strands become tacky, adhering to adjacent stands. Once cooled, movement of the textile strands is restricted (i.e., the textile at that location stiffens).

One additional type of heat sensitive strand which may be utilized is a thermosetting strand. Thermosetting strands are generally flexible under ambient conditions, but become irreversibly inflexible upon heating.

By way of specific example, the locking bands 610, 615 are woven, with selected courses and wales being fusible strands such as low-melt yarns (e.g., yarns formed of thermoplastic polyurethane (TPU)). Remaining strands in the woven structure may be hard yarns. Hard yarns include natural and/or synthetic spun staple yarns, natural and/or synthetic continuous filament yarns, and/or combinations thereof. By way of specific example, natural fibers include cellulosic fibers (e.g., cotton, bamboo) and protein fibers (e.g., wool, silk, and soybean). Synthetic fibers include polyester fibers (poly(ethylene terephthalate) fibers and poly (trimethylene terephthalate) fibers), polycaprolactam fibers, poly(hexamethylene adipamide) fibers, acrylic fibers, acetate fibers, rayon fibers, nylon fibers and combinations thereof.

With this configuration, at least a portion of the yarns forming the woven fabric become fused, enveloping surrounding yarns and inhibiting elastic expansion of the fabric forming the locking bands 610, 615.

The band cooperate to prevent the foot from lifting off the footbed. During a golf swing, the forces acting on the golfer's foot can cause the foot to draw off the sole or footbed. Resiliency in the upper permits this lifting, with the upper stretching to accommodate upward foot movement. Separation of the foot from the footbed, moreover, may result in the shoe lifting off of the playing surface. The bands of the integrated lockdown system inhibits elastic deformation of the upper in the midfoot and heel regions of the upper. As a result, a greater portion of the wearer's foot remains in contact with the sole. This, in turn, is believed to improve stability of the foot and/or increase power in the wearer's golf swing.

The article of footwear may further include a traction system configured to resist rotational slippage during a swing. As a golfer begins the backswing, the rearward foot tends to experience a greater vertical force and tends to rotate lateral outward at the forefoot region and medially inward at the rearfoot region. During the back swing, rearfoot foot serves to counter rotational force of the legs, hips, and upper body of the golfer. At the same time, most of the golfer's weight shifts to the rearward foot such that weight is pulled off of the forward. As the golfer begins the downswing, the golfer's weight is shifted from the rearward foot to the forward foot, causing the forward foot to rotate laterally outward at the forefoot region and medially inward at the rearfoot region. This rotation harms accuracy and strength of the swing.

Figure 7:
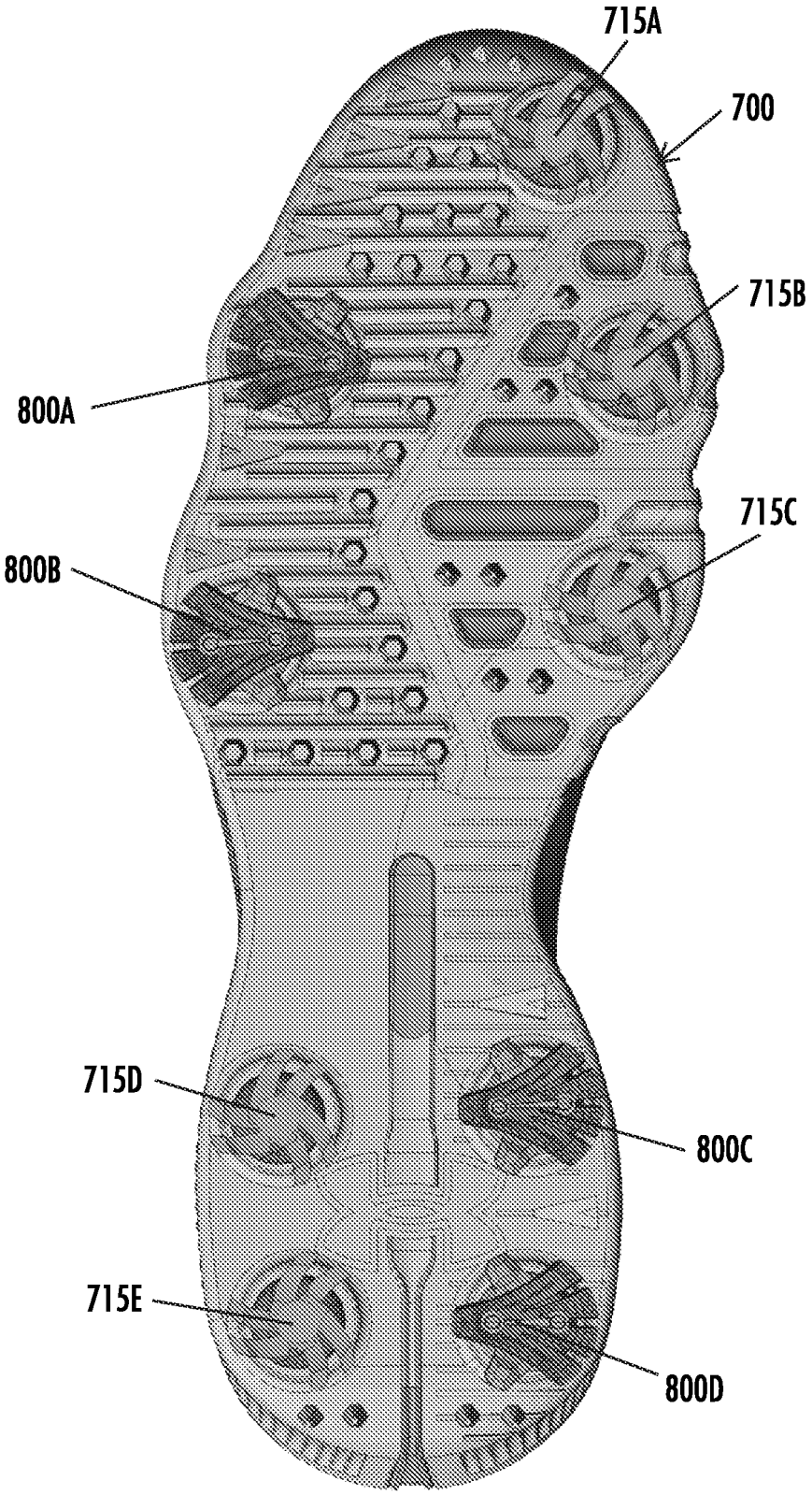
FIG. 7 is a bottom view of a cleat plate including traction elements in accordance with an embodiment of the invention.

Thus, for most golfers, the forward foot tends to rotate or in a counter-clockwise direction (for a righthanded golfer) during the downswing as weight is transferred to the lead foot and the torso rotates relative to the hips. To prevent rotation of the foot directional traction elements may be utilized. Referring to FIG. 7, the cleat arrangement 700 includes directional traction and omni directional traction elements oriented in predisposed positions. Specifically, the cleat arrangement includes one or more lateral, forefoot directional traction elements 800A, 800B that cooperate to resist lateral rotation in the forefoot, and one or more medial, rearfoot, directional traction elements 800C, 800D that cooperate to resist medial rotation in the hindfoot. Opposite the directional traction elements are omni- or non-directional traction elements 715A-715E operable to provide traction in all directions.

Figure 8B:
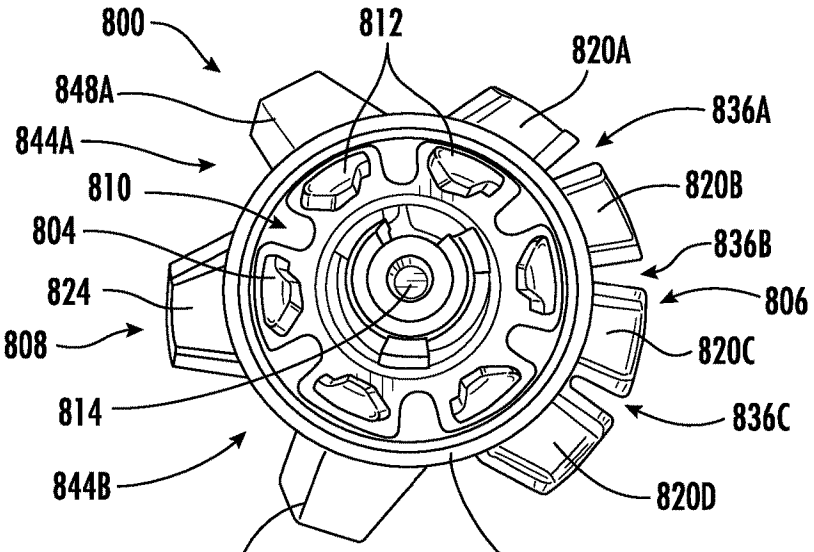
FIG. 8B is a top view of the traction element shown in FIG. 8A.
Figure 8C:
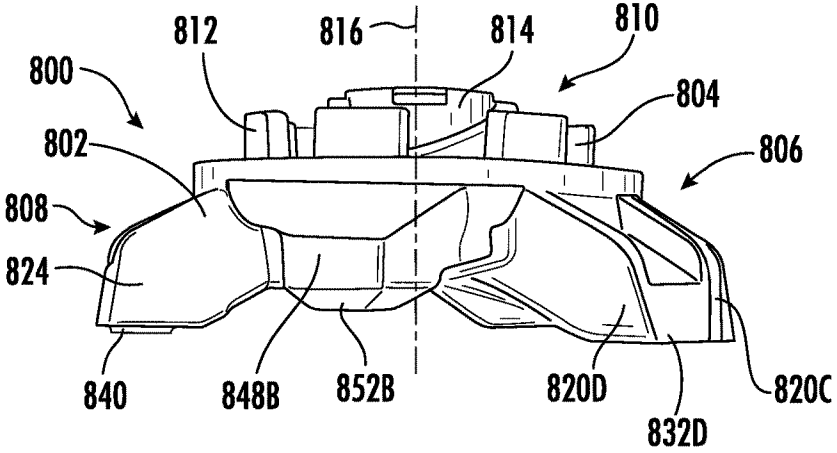
FIG. 8C is a side view of the traction element shown in FIG. 8A.
Figure 8A:
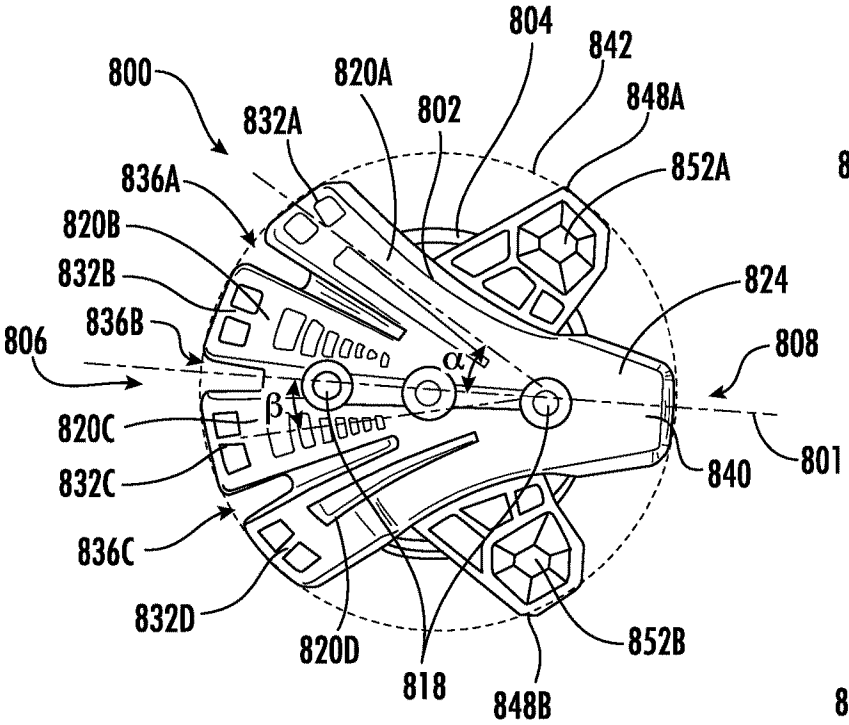
FIG. 8A is a bottom view of a traction element in accordance with an embodiment of the invention.

With reference now to FIG. 8A, FIG. 8B and FIG. 8C, the directional traction element or golf cleat 800 is formed of a first material 802 and a second material 804. The first material has a softer durometer than the second material. The golf cleat 800 includes a generally circular hub and one or more traction elements or legs extending outward and downward from the hub. The cleat 800 defines a first or outboard side 806 (also referred to as the outer side or exterior side) and a second or inboard side 808 (also referred to as the inner side or interior side). The golf cleat 800 is symmetrical about an axis 801 that divides the golf cleat 800 in half from the first side 806 to the second side 808 (i.e. the axis that extends left-to-right in the view of FIG. 8A and through the wrench recesses 818).

The circular hub includes a mount coupling 810. The mount coupling 810 includes perimeter projections 812 on the upper side of the cleat 800 with a threaded post 814 centrally located within the perimeter projections 812. The threaded post 814 defines an axis of insertion 816 for cleat 800. The cleat 800 is configured to be rotated about the axis of insertion 816 when the cleat 800 engages to the cleat mounts on the sole of the golf shoe.

In the illustrated embodiment, the traction elements or legs including a set of four sequentially aligned and substantially evenly spaced dynamic traction elements 820A-D formed of the first material 802 and disposed on the first side 806 of the cleat 800. Additionally, the cleat 800 includes a dynamic traction element 824 centrally disposed along the hub on the cleat second side 808. The dynamic traction elements 820A, 820B, 820C, 820D, 824 may be formed of the first material 802.

The four legs 820A-D are in a fanned configuration. In other words, the leg 824 forms a base leg of the fanned configuration along the axis 801 in such a way that the base leg 824 is bisected by the axis 801, while the four legs 820A-D fan out or flare outwardly from the axis 801 in the direction from the second side 808 toward the first side 806. The outer legs 820A, 820D may extend at an angle $\alpha$ relative to the axis of symmetry 801 of between approximately 30 degrees and approximately 45 degrees, and the inner legs 820B-C may extend at an angle $\beta$ relative to the axis of symmetry of between approximately 5 degrees and approximately 20 degrees.

Each of the legs 820A-D on the first side 806 extends radially outward and downward from the center of the cleat 800 and form a traction member 832A-D at the distal end of the legs 820A-D. Each of the traction members 832A-D is spaced apart from adjacent traction members 832A-D by a void/gap 836A-C in which there is none of the first or second material 802, 804. Likewise, the leg 824 on the second side 808 extends radially outward and downward from the center of the cleat 800 so as to form a traction member 840 at the distal end of the leg 808. The traction members 832A-D and 840 define relatively sharp edges as compared to the rest of the legs 820A-D and 824.

In some embodiments, the distal end of the traction members 832A-D may all be in the same plane. In still further embodiments, the distal end of the traction member 840 is in the same plane as the distal ends of the traction members 832A-D, though in other embodiments the distal end of the traction member 840 is vertically above the plane in which the distal ends of the traction members 832A-D terminate. The radially outermost end of each of the legs 820A-D may, in one embodiment, lie along the same arc and, in certain embodiments, the arc (for example circle 842) may be centered at the axis of insertion 816. In some embodiments, the radially outermost end of the leg 824 may be on the same arc.

The second material 804 forms two legs or static traction elements 848A, 848B, both of which are on the second side 808 of the cleat 800. The second material legs 848A-B each extend radially outward and downward from the center of the cleat 800 and have a traction member 852A-B at the distal end thereof. In the illustrated embodiment, the distal ends of the second material legs 848A B are on the same circle 842 as the distal ends of the first material legs 820A-D, 840.

The upper surface of each of the legs 820A-D, 824, and 848A-B forms a convex surface, while the lower surface forms a concave surface. In particular, the upper surfaces of the legs 820A-D, 824 of the first material 802 define a dome shape, while the lower surfaces of the legs 820A-D, 824 also define a dome shape.

The traction members 852A-B are recessed relative to the traction members 832A-D or, in other words, are set back vertically from the plane in which the traction members 832A-D are located. An angle defined with a vertex at the axis of insertion 816 between the two legs 848A, 848B may be, for example, between approximately 110 and 130 degrees. In some embodiments, the legs 848A-B are formed integrally and monolithically with one another and, in further embodiments, are formed integrally and monolithically with the mount coupling 810.

The cleats 800 may be formed in a two-shot injection molding process. In such a process, the portion formed by the second material 804 is molded in a first injection molding process. The second material 804 is then placed into another mold, and the first material 802 is overmolded around the portion of the second material 804 so as to form the final cleat 800.

As illustrated in FIG. 7, in some embodiments, the cleats 800 are positioned in a predetermined orientation, with the first side 806 is oriented to face outward (outboard, toward the perimeter of the plate) and the second side 808 is oriented inward (inboard). In other words, for cleats 800A, 800B mounted on the lateral side of the shoe, the first side 806 is oriented toward the lateral side, while for cleats 800C, 800D mounted on the medial side of the shoe, the first side 806 is oriented toward the medial side.

With the disclosed configuration, a user may customize the rotational traction of each shoe based on the user's performance tendencies. By way of example, a user who experiences prominent forefoot rotation during the swing (counter clockwise rotation in the left foot and clockwise rotation in the right foot) may couple the cleats 800 to the lateral forefoot receptacles of the sole the first orientation to inhibit rotation of the forefoot during game play (e.g., the golf swing). Similarly, a user who experiences prominent rearfoot (heel) rotation may couple the cleats 800 to the medial rearfoot receptacles in the first orientation to inhibit such rotation.

As noted above, omni or non-directional cleats 715A-715E may be coupled to the sole at desired receptacle locations. In an embodiment, such cleats 715A-715E include dynamic traction elements that are secured to and project downwardly and outwardly from a hub and resiliently flex under the load of the weight of a wearer.

During a golf back swing, the golfer's rear foot has a tendency to rotate such that the lateral forefoot side of the foot pivots outwardly, while the medial hindfoot side pivots inwardly. The traction members 832A-D of each of the cleats 800A-800D are configured to dig into the surface on which the golfer is standing during the backswing, thereby inhibiting rotation of the back foot during the golfer's backswing.

Similarly, during the downswing, the golfer's lead foot has a tendency to rotate such that the lateral forefoot side of the foot pivots outwardly and the medial hindfoot side pivots inwardly. The traction members 832A-D of the golfer's lead foot likewise dig into the surface on which the golfer is standing during the downswing, thereby inhibiting rotation of the lead foot during the downswing.

The softer durometer first material 802 enables limited deformation of the golf cleat 800 under the weight of the golfer so that the cleat 800 does not break or disconnect from the cleat mount. If the cleat 800 continues to dig into the surface, the legs 852A-B, which are formed of the harder durometer second material 804, engage into the ground to provide additional support to the golfer. The harder durometer legs 852A-B therefore provide added stabilization and further inhibit additional rotation of the golfer's feet.

As a result, the cleats 800 reduce rotation of the golfer's feet during the backswing and downswing. By reducing rotation of the golfer's foot, the Hendrix bar can remain locked to the ground longer. The cleats 800 and the configuration of the cleats 800 illustrated in the shoes can therefore provide a more stable base for the golfer. As a result, the cleat arrangement enables improved accuracy and increased power for a golfer's shot.

Figure 9:
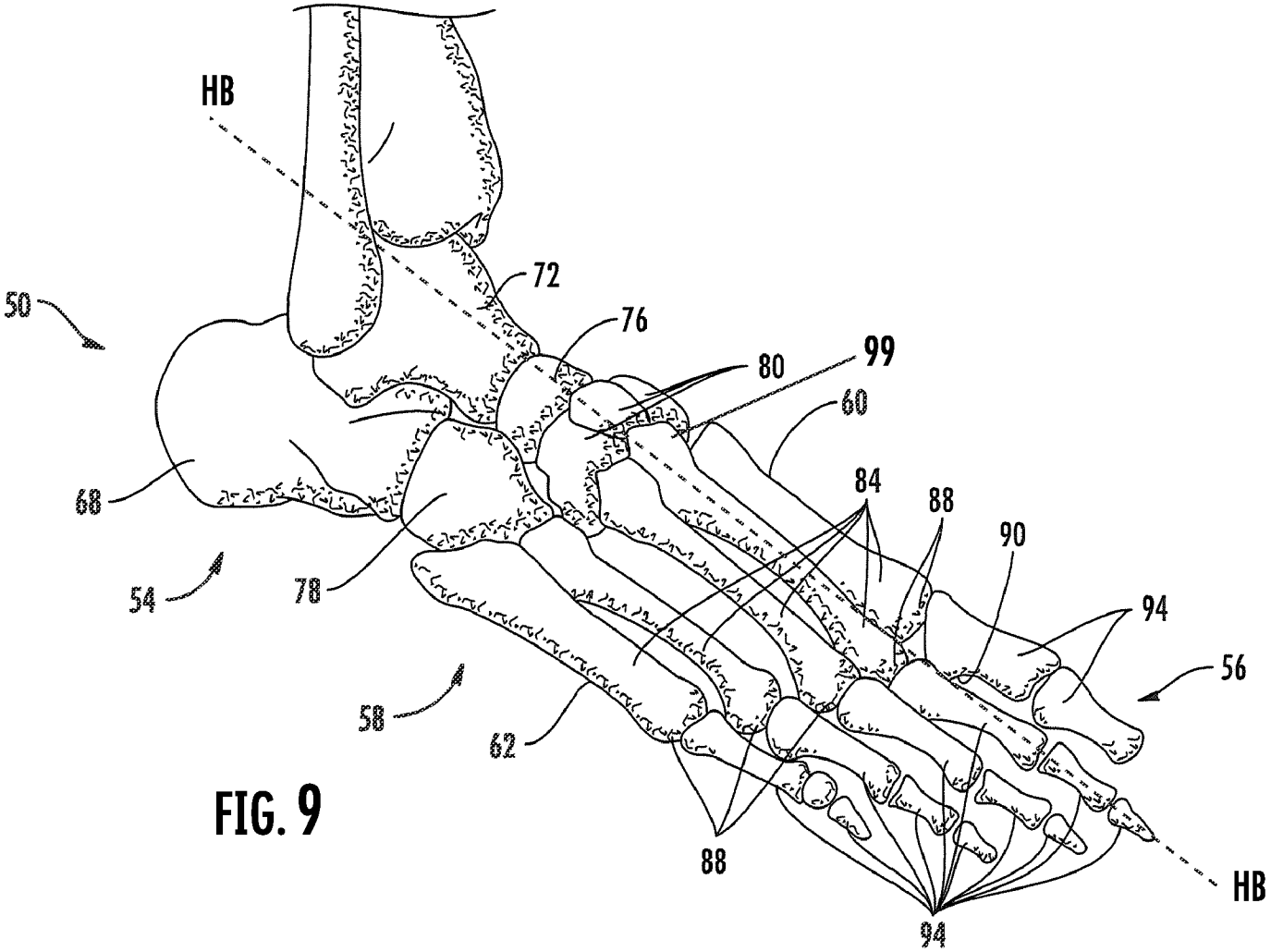
FIG. 9 is a schematic drawing of a medial side view of a bone structure of a foot.
Figure 10:
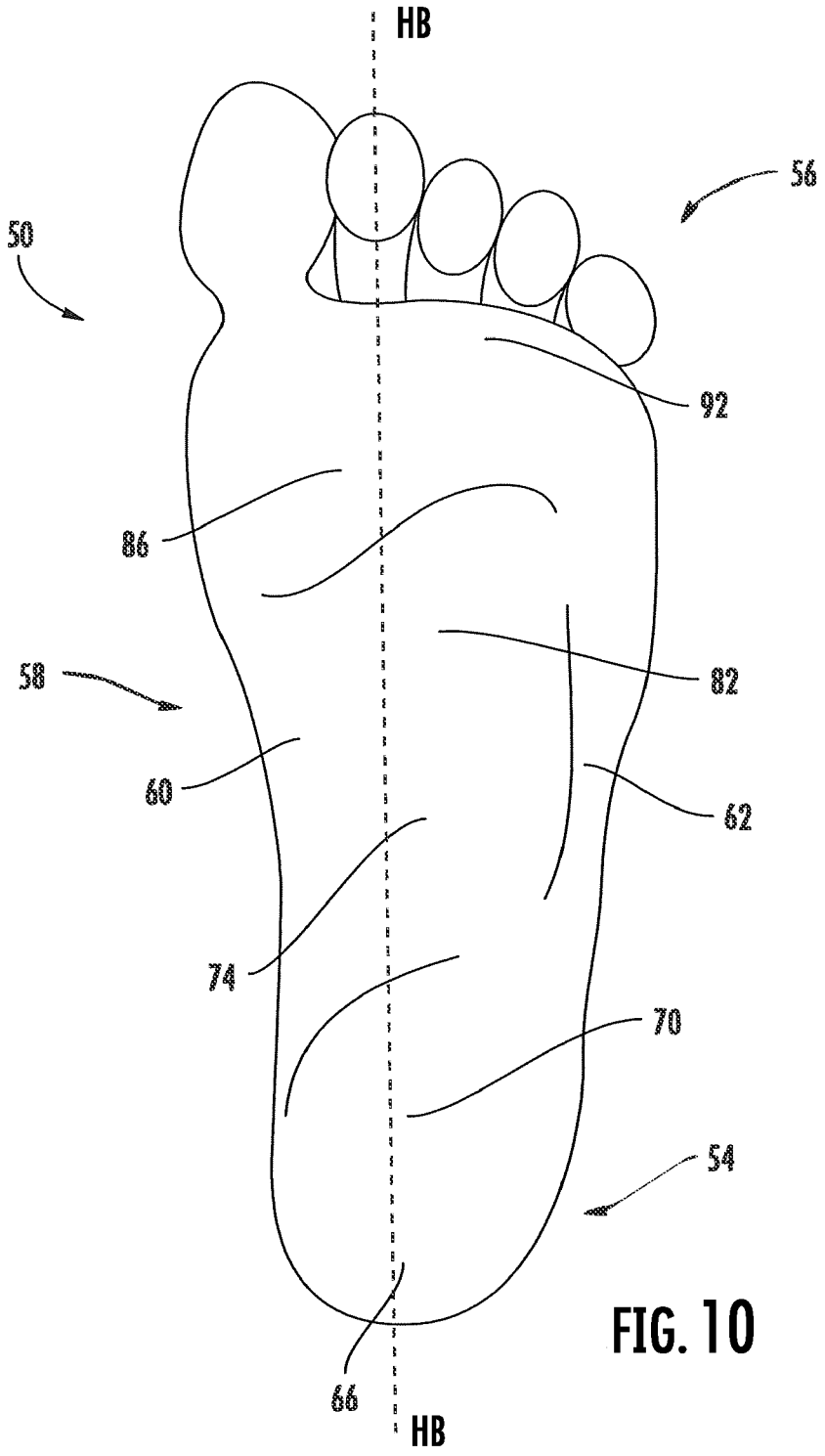
FIG. 10 is a schematic drawing of a bottom view of a foot.

The above described footwear works with the anatomy of a foot. Referring to FIGS. 9 and 10, a user's foot 50 is shown including a heel 54, toes 56, an arch 58, a medial side 60, and a lateral side 62. A calcaneus region 66 on the bottom of the foot 50 is located substantially beneath a calcaneus bone 68 of the user, near the heel 54. A talus region 70 on the bottom of the foot 50 is located substantially beneath a talus bone 72 of the user, between the heel 54 and the arch 58. A longitudinal arch region 74 on the bottom of the foot 50 is located substantially beneath a navicular bone 76, a cuboid bone 78 and cuneiform bones 80 of the user, near the arch 58. A metatarsal region 82 on the bottom of the foot 50 is located substantially beneath metatarsal bones 84 of the user, between the arch 58 and the toes 56. A ball of the foot region 86 on the bottom of the foot 50 is located substantially beneath the metatarsal-phalangeal joints 88 and sesamoids 90 (shown in FIG. 14) of the user, between the arch 58 and the toes 56 and closer to the medial side 60 than the lateral side 62. A toe region 92 on the bottom of the foot 50 is located substantially beneath phalangeal bones 94 of the user, near the toes 56. The Hendrix torsion bar HB is an axis that extends through the second metatarsal 99 and the calcaneus 68.

Sole structure systems described above can permit the foot to maintain a relatively large contact area with the playing surface as weight shifts and/or as the foot rotates. As explained above, weight will shift during a golf swing, with the center of gravity moving from the center to the medial side or the lateral side. The sole systems described encourage proper placement of the weight via the flexure taking place within the plate, the midsole and/or both. In particular, it encourages weight placement and movement along the Hendrix bar (HB). This, along with the independent movement of the lateral and/or medial sides of the traction elements (via the plate), enable increased contact with the playing surface compared to shoes lacking one or more of the above configurations.

Thus, rotary, horizontal and vertical forces—either independently or in concert with each other—act on a user during a golf swing, thereby affecting club velocity and, ultimately, ball launch conditions. Failure to properly position the center of gravity during a swing is believed to diminish the power of the swing. Vertical ground reaction forces generated by ground contact are believed to affect club velocity. Thus, maximizing the force applied to the ground along, e.g., the lead foot, may improve launch conditions.

It is intended that the present invention covers the modifications and variations of this invention provided they come within the scope of the appended claims and their equivalents. It is to be understood that terms such as "top," "bottom," "front," "rear," "side," "height," "length," "width," "upper," "lower," "interior," "exterior," "medial," "lateral," and the like as may be used herein, merely describe points of reference and do not limit the present invention to any particular orientation or configuration.

What is claimed is:

1. An article of footwear defining a hindfoot region, a forefoot region, a lateral side, and a medial side, the article of footwear comprising:
- an upper; and
- a sole structure including:
  - a plate comprising a plurality of traction elements, at least one stability zone, and a plate flexure zone, wherein the plate is thinner in the flexure zone than in the at least one stability zone,
  - a midsole positioned below the upper such that it is arranged between the upper and the plate, the midsole comprising:
    - a first midsole component formed of compressible material extending from the hindfoot region to the forefoot region, the first midsole component including a cavity in the hindfoot region, wherein the compressible material of the first midsole component is a first foam having a first recovery value; and
    - a second midsole component formed of compressible material configured to fit within the cavity of the first midsole component, the second component extending from the hindfoot region to the forefoot region, wherein the compressible material of the second midsole component is a second foam having a second recovery value, the second recovery value being greater than the first recovery value;
  - wherein the second midsole component is nested within the cavity of the first midsole component in the hindfoot region, wherein the second midsole component is laterally adjacent to and abuts the first midsole component along a seam in the forefoot region, the seam extending through the midsole from an upper surface to a lower surface of the midsole, and wherein the second midsole component is exposed to the plate in the area of the flexure zone.

2. The article of footwear of claim 1, wherein the second midsole component further comprises a textile web coupled to the second foam.

3. The article of footwear of claim 1, wherein the plurality of traction elements are coupled to the plate, the plurality of traction elements including a directional traction element and an omnidirectional traction element.

4. The article of footwear of claim 1, wherein the upper comprises a lockdown system including a lockdown band extending from the lateral side to the medial side, the lockdown band having less than 5% stretch.

5. The article of footwear of claim 4, wherein the lockdown band comprises a woven textile formed of fused strands.

6. An article of footwear comprising:
- an upper; and
- a sole structure including:
  - a plate comprising a plurality of traction elements and at least two zones of different thickness, and
  - a midsole comprising:
    - a first midsole component formed of a first compressible material extending across a hindfoot region of the midsole and along a lateral side of a forefoot region of the midsole, wherein the first compressible material is a first foam having a first recovery value; and
    - a second midsole component formed of a second compressible material extending along a center of the hindfoot region and along a medial side of the forefoot region such that the first midsole component and the second midsole component are nested in the hindfoot region and laterally adjacent and contiguous in the forefoot region, wherein the second compressible material is a second foam having a second recovery value, the second recovery value being greater than the first recovery value, the second midsole component exposed to the plate;
  - wherein the first midsole component and the second midsole component together provide a generally continuous upper surface that extends from the forefoot region to the hindfoot region of the midsole;
  - wherein a seam is provided between the first midsole component and the second midsole component in the forefoot region of the midsole, the seam positioned along an abutment of a lateral edge of the second midsole component and a medial edge of the first midsole component, the seam extending a depth from the upper surface to a lower surface of the midsole and a length that extends axially from the forefoot region to a midfoot region of the midsole; and wherein the lateral edge of the second midsole component includes a concave portion positioned forward of a convex portion such that the seam includes a plurality of curvatures.

7. The article of footwear of claim 6, wherein the second midsole component further comprises a textile web coupled to the second foam.

8. The article of footwear of claim 7, wherein the textile web is an open mesh fabric formed of elongated interwoven yarn strands defining apertures, wherein the open mesh fabric wholly or partially encases the second midsole component.

9. The article of footwear of claim 6, wherein the first midsole component includes an exposed lateral forefoot surface on an exterior of the midsole in the forefoot region, and wherein the second midsole component includes an exposed medial forefoot surface on the exterior of the midsole in the forefoot region.

10. The article of footwear of claim 9, wherein the exposed medial forefoot surface is a convex surface that curves outwardly from a forward-most part of the midsole and then curves back inwardly near a midfoot region of the midsole.

11. The article of footwear of claim 10, wherein the first midsole component includes an exposed lateral hindfoot surface and an exposed medial hindfoot surface in the hindfoot region.

12. The article of footwear of claim 11, wherein the second midsole component includes an exposed central hindfoot surface positioned between the exposed medial hindfoot surface and the exposed lateral hindfoot surface of the first midsole component.

13. The article of footwear of claim 6, wherein the concave portion of the lateral edge of the second midsole component abuts a complementary convex portion of the medial edge of the first midsole component, and wherein the convex portion of the lateral edge of the second midsole component abuts a complementary concave portion of the medial edge of the first midsole component.

14. The article of footwear of claim 6, wherein the plate includes a forefoot stability zone and a hindfoot stability zone and a medial forefoot flexure zone, the medial forefoot flexure zone being thinner than both the forefoot stability zone and the hindfoot stability zone, and wherein the second midsole component is exposed to the medial forefoot flexure zone.

15. The article of footwear of claim 14, wherein the plate further includes a plurality of cleat mounts, including at least one cleat mount in the each of the forefoot stability zone, the hindfoot stability zone, and the medial forefoot flexure zone.

16. An article of footwear configured to receive a human foot, the article of footwear comprising:

an upper; and a sole structure including:

a plate comprising at least one stability zone and a medial forefoot flexure zone, wherein the plate is thinner in the medial forefoot zone than in the at least one stability zone, and a midsole comprising:

a first midsole component comprised of a low recovery foam possessing a rebound value of less than 50%;

a second midsole component comprised of a high recovery foam possessing a rebound value of greater than 50%;

wherein the first midsole component and second midsole component are together configured to resist lateral or medial shift of a hindfoot region of the foot, and together configured to urge the foot toward a center of the sole when a load provided by the human is primarily on the hindfoot region of the foot and urge a forefoot region of the foot toward a medial side of the sole when a load provided by the human is primarily on the forefoot region of the foot;

wherein the first midsole component extends across a hindfoot region of the midsole and along a lateral side of a forefoot region of the midsole, and wherein the second midsole component extends along a center of the hindfoot region of the midsole and along a medial side of the forefoot region of the midsole such that the second midsole component and the first midsole component are nested in the hindfoot region of the midsole, and the first midsole component and the second midsole component are laterally adjacent and contiguous in the forefoot region of the midsole with a seam extending between the first midsole component and the second midsole component in the forefoot region of the midsole, wherein the seam is defined by a plurality of curves along a length of the seam that extends axially from the forefoot region to a midfoot region of the midsole; and wherein the second midsole component is exposed to the medial forefoot flexure zone of the plate.

17. The article of footwear of claim 16, wherein the second midsole component further comprises a textile web coupled to the high recovery foam, the textile web provided by an open mesh fabric formed of elongated interwoven yarn strands defining apertures, wherein the open mesh fabric wholly or partially encases the first midsole component.

18. The article of footwear of claim 16, wherein the first midsole component includes an exposed lateral forefoot surface on an exterior of the midsole in the forefoot region of the midsole, and wherein the second midsole component includes an exposed medial forefoot surface on the exterior of the midsole in the forefoot region of the midsole.

19. The article of footwear of claim 16, wherein the first midsole component includes an exposed lateral hindfoot surface and an exposed medial hindfoot surface in the hindfoot region of the midsole.

20. The article of footwear of claim 19, wherein the second midsole component includes an exposed central hindfoot surface positioned at a rear heel position of the sole structure between the exposed medial hindfoot surface and the exposed lateral hindfoot surface of the first midsole component.

* * * * *